US005306171A

United States Patent [19]

Marshall

[11] Patent Number: 5,306,171

[45] Date of Patent: Apr. 26, 1994

[54] BOWTIE CONNECTOR WITH ADDITIONAL LEAF CONTACTS

[75] Inventor: Robert E. Marshall, State College, Pa.

[73] Assignee: Elco Corporation, Huntingdon, Pa.

[21] Appl. No.: 927,077

[22] Filed: Aug. 7, 1992

[51] Int. Cl.[5] ..... H01R 13/28

[52] U.S. Cl. ..... 439/284; 439/287; 439/291

[58] Field of Search ..... 439/284, 287, 289-291, 439/295

[56] References Cited

U.S. PATENT DOCUMENTS

| | | | |
|---|---|---|---|
| 2,124,207 | 7/1938 | Neesen | 439/284 |
| 3,086,188 | 4/1963 | Ross | 439/291 |
| 5,125,848 | 6/1992 | Zimmerly | 439/287 |

FOREIGN PATENT DOCUMENTS

| | | | |
|---|---|---|---|
| 2290056 | 5/1976 | France | 439/284 |

*Primary Examiner*—Paula A. Bradley

*Attorney, Agent, or Firm*—Spensley Horn Jubas & Lubitz

[57] ABSTRACT

An improved connector for orthogonally mounting circuit boards. The preferred embodiment of the present invention includes 40 female contacts which protrude from the two coplanar triangular surfaces. An additional 40 male contacts are located within channels in triangular projections. Further, the preferred embodiment of the present invention has an additional 16 leaf contacts located adjacent to the inner walls of the triangular projections. Each leaf contact protrudes from the inner wall of the triangular projections and comes into electrical contact with a corresponding leaf contact of a mating connector as the leaf contacts of each connector slide past one another.

9 Claims, 5 Drawing Sheets

SECTION 2-2

SECTION 2-2

SECTION 2-2

SECTION 1-1

BOWTIE CONNECTOR WITH ADDITIONAL LEAF CONTACTS

BACKGROUND OF THE INVENTION

1. Field of the Invention

The present invention relates to an electrical connector for interconnecting electronic subsystems, and more particularly to an improved connector for orthogonally mounting circuit boards.

2. Description of Related Art

It is common today to design electronic systems having a multitude of subsystems which are electrically interconnected by means of electrical connectors. Often times such subsystems are designed on printed circuit boards. Therefore, it may be necessary to couple thousands of electrical signals between a large number of printed circuit boards within a system. Space limitations are frequently imposed upon the designer of such systems, making the size of the system, subsystem, and the components thereof, a critical factor. Therefore, the external dimensions of a connector suited to such applications should be very small.

One means for interconnecting large numbers of printed circuit boards within a system in which space limitations are imposed is disclosed in U.S. Pat. No. 4,708,660 issued to Claeys, et al., incorporated herein by reference. Claeys discloses a connector for orthogonally mounting circuit boards. The Claeys invention allows a first stack of horizontally-oriented printed circuit boards to be interconnected to a second stack of vertically-oriented printed circuit boards. This arrangement permits signals from any one circuit board to be coupled to any other circuit board over a relatively short signal path. Such arrangements have proved advantageous in a variety of applications, such as large multi-port memory systems in which memory is located on the horizontal boards and ports are provided on the vertical boards, and computing systems in which horizontal boards are used as adders, multipliers, and other "functional" subsystems and vertical boards are used for control memory. Attached to each circuit board in such arrangements, and running along an interfacing edge thereof, is an elongated separator. The separator includes an elongated base running along the interface edge and a plurality of perpendicular spaced-apart legs extending away from the circuit board. Supported along the separator are a plurality of electrical connectors. Each connector is secured to a pair of legs by a retaining cap. The connectors provide the means by which signals are coupled from one printed circuit board to another. Each connector has an electrically insulated body which is cubic in shape. Two generally triangularly-shaped opposing projections extend from one end of the cubic body. A plurality of socket contacts extend longitudinally from the same end of the body, but only about half as far as the triangularly-shaped projections. A plurality of male contacts are located within cylindrical channels in the triangular projections, and have a relative spacing and positioning equal to the relative spacing and positioning of the socket contacts. In the Claeys connector, each triangular projection has 20 contacts. Therefore, a total of 80 contacts (40 male and 40 female) are present in the connector. When one connector is rotated 90° about its longitudinal axis, and 180° about an orthogonal axis with respect to a second connector such that the projections of each connector face the other, the two connectors may be mated. When so mated, the projections of each connector are interleaved. Such connectors are also known as "bowtie" connectors, from the shape of the opposed triangularly-shaped projections.

While prior bowtie connector systems have a number of advantages as the number of electrical signals to be coupled from one printed circuit board to another increases, a need has arisen to increase the number of contacts in standard size bowtie connectors. That is, there is presently a need for an improved connector for orthogonally mounting circuit boards having the same external dimensions as those connectors known in the prior art, yet having more contact positions. The present invention provides such a connector.

SUMMARY OF THE INVENTION

The details of the preferred embodiment of the present invention are set forth in the accompanying drawings and the description below. Once the details of the invention are known, numerous additional innovations and changes will become obvious to one skilled in the art.

The present invention is an improved bowtie connector for orthogonally mounting circuit boards. The present invention includes a housing having two generally triangularly-shaped projections forming shoulders which oppose one another, each projection having a triangularly-shaped end surface which is coplanar to the triangularly-shaped end surface of the other projection. The shoulders define two additional generally triangularly-shaped lower surfaces. The two lower surfaces lie along a second plane parallel to and spaced apart from the first plane defined by the triangularly-shaped end surfaces of the projections. The two lower surfaces so defined are rotated 90° from the two end surfaces of the projections about an axis orthogonal to the two planes.

The present invention further includes three types of electrical contacts for conducting electrical signals from a first printed circuit board to a second printed circuit board. The first type of contacts are female contacts which protrude from the two lower surfaces. The preferred embodiment of the present invention has 40 female contacts. The second type of contacts are male contacts located within channels in the projections. The preferred embodiment of the present invention has 40 male contacts. The third type of contacts comprise leaf contacts located on opposing inner side walls of the triangularly-shaped projections. The preferred embodiment of the present invention has 16 leaf contacts. Each leaf contact extends from the inner side wall of the projections and comes into electrical contact with a corresponding leaf contact of a mating connector as the leaf contacts of each connector slide past one another.

In the preferred embodiment, the contacts (i.e., 40 male, 40 female, and 16 leaf) define a $10 \times 10$ grid. Each contact corresponds to a distinct one of 96 positions on the grid (the remaining 4 positions located in the center of the grid are vacant). Each contact extends through the housing, and has an elongated termination end which protrudes through the end of the housing. The elongated termination end of each contact is preferably bent at a 90° angle for ease of mounting on a printed circuit board. The further up the body a contact exits the housing, the further from the housing the contact extends before bending in the direction of a printed circuit board.

The addition of 16 leaf contacts to a connector for orthogonally mounting circuit boards, such as the connector disclosed in U.S. Pat. No. 4,708,660, requires no additional printed-circuit board space or any increase in the size of the bowtie connector. Thus, the signal density of a connector for orthogonally mounting circuit boards made in accordance with the present invention is increased.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings refer to like elements.

DETAILED DESCRIPTION OF THE INVENTION

Throughout this description, the preferred embodiment and examples shown should be considered as exemplars, rather than as limitations on the present invention.

Figure 1:
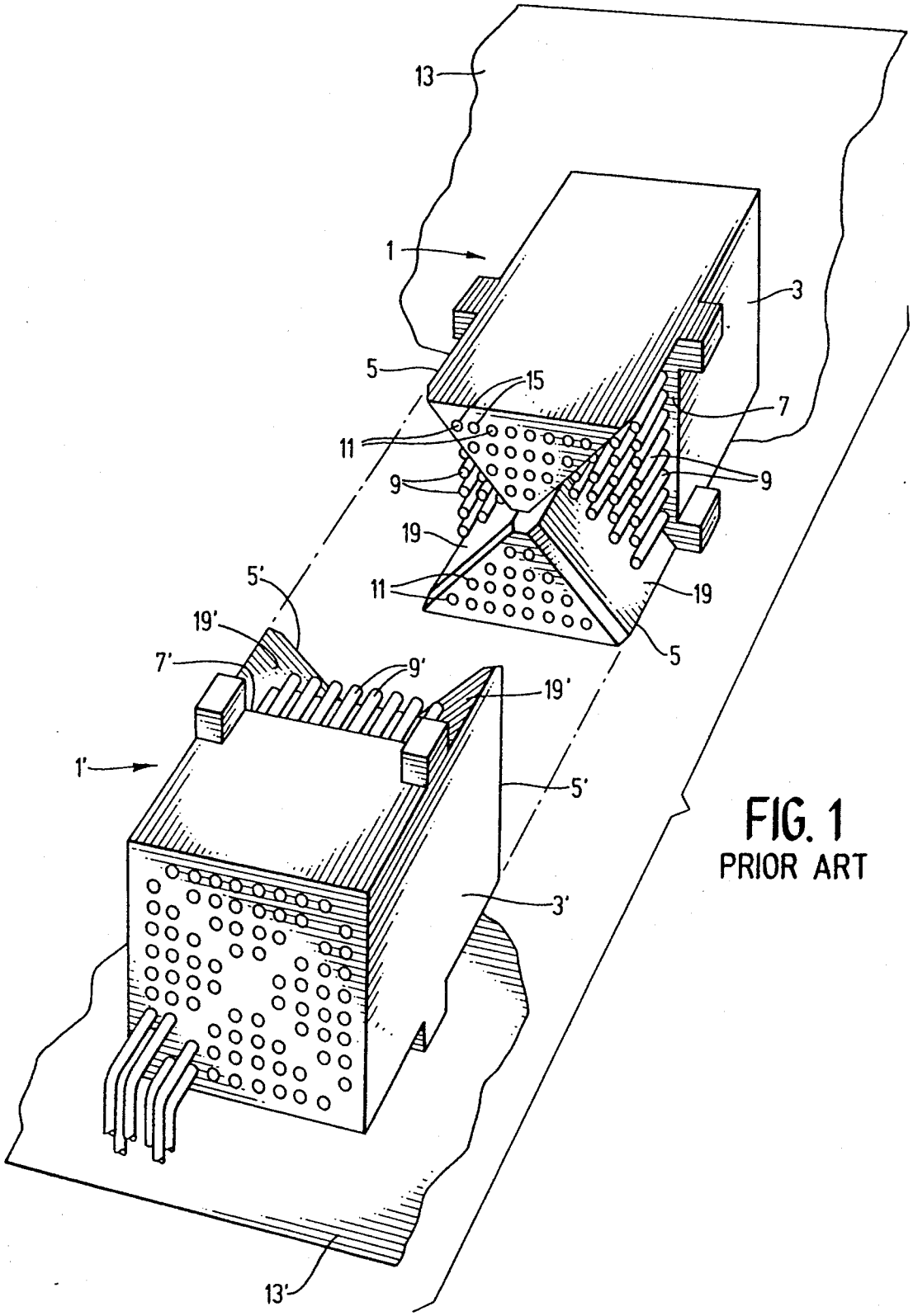
FIG. 1 PRIOR ART
FIG. 1 is a perspective view of a prior art connector for orthogonally mounting printed circuit boards.

FIG. 1 illustrates the prior art connector (the "Claeys" connector) disclosed in U.S. Pat. No. 4,708,660 (the '660 Patent) issued to Claeys, et al., which is herein incorporated by reference. The following description of the prior art connector is given only to aid in understanding the improvement thereto, which is the present invention.

The Claeys connector 1 has a generally cubic insulated body 3 having a contact end from which two generally-triangularly-shaped projections 5 protrude. The projection 5 define two shoulder-like lower surfaces 7 upon the contact end of the body 3 which are also generally triangularly-shaped, and which are connected at one corner, thereby separating the projections 5. A plurality of electrical contacts 9, 11 run through the body 3 of the connector 1. Each contact 9, 11 conducts an electrical signal from a printed circuit board 13 upon which the connector 1 is mounted, to a corresponding contact of a second, mating connector 1' turned 90° with respect to the first connector 1.

In the illustrated Claeys connector 1, there are 40 male contacts 11 and 40 female contacts 9, for a total of 80 contacts. The male contacts 11 are located within channels 15 in the projections 5. The female contacts 9 protrude from the surface 7 of the connector 1. When one connector 1 is mated to another essentially identical connector 1', the inner side walls 19 of the projections 5 of one connector 1 slide past corresponding inner side walls 19' of the projections 5' of the mating connector 1'. The male contacts 11 within the channels 15 of each connector 1 enter the female contacts 9' of the other connector 1' to create an electrical point of contact through which electrical signals may be transmitted.

Figure 2:
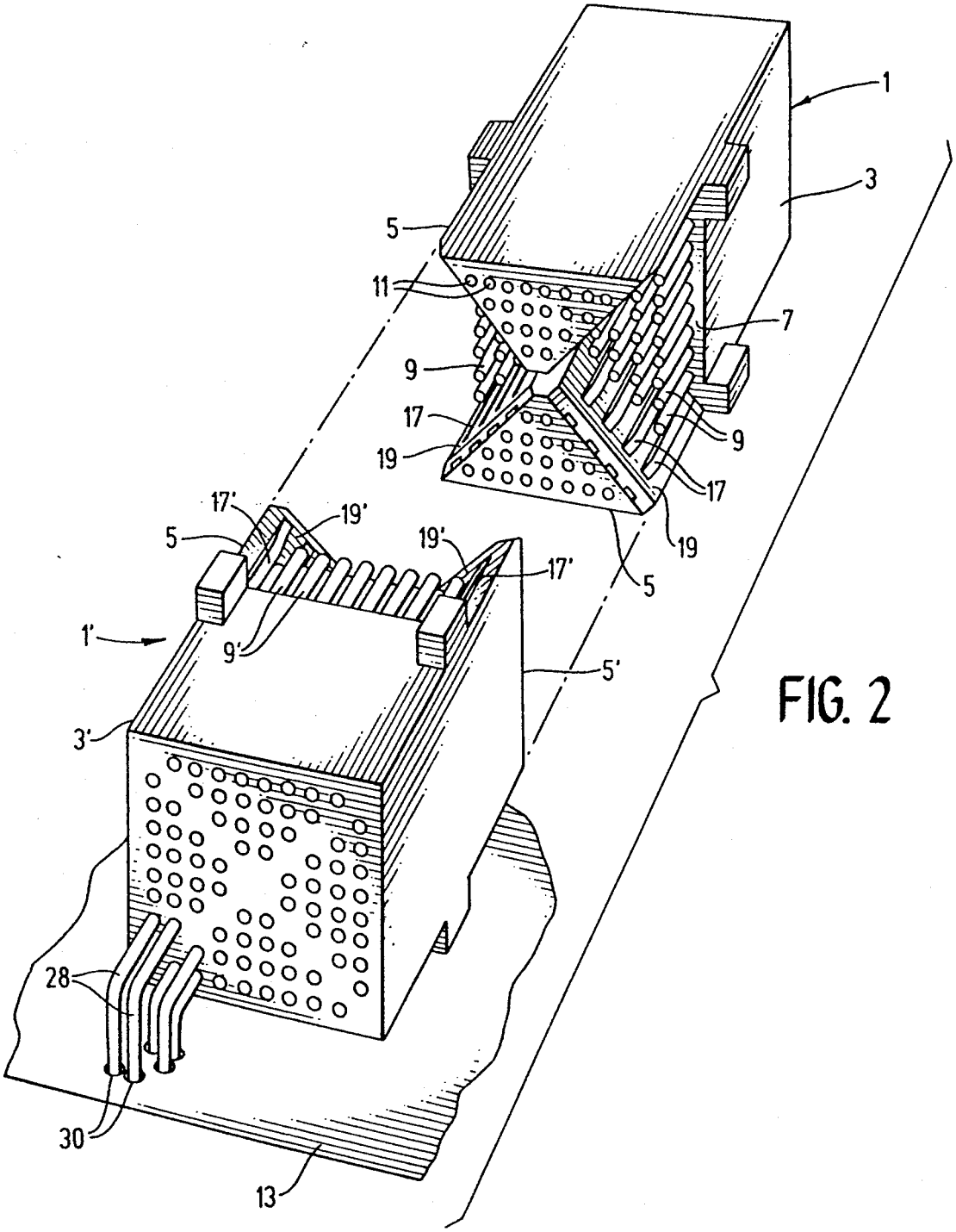
FIG. 2 is a perspective view of the present invention.
Figure 3:
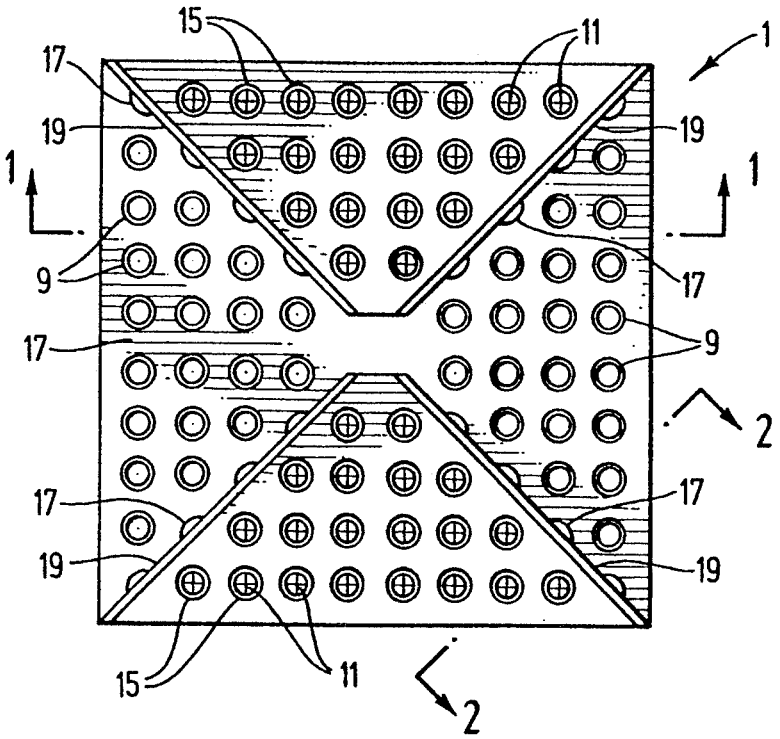
FIG. 3 is a front plane view of the present invention.
Figure 4:
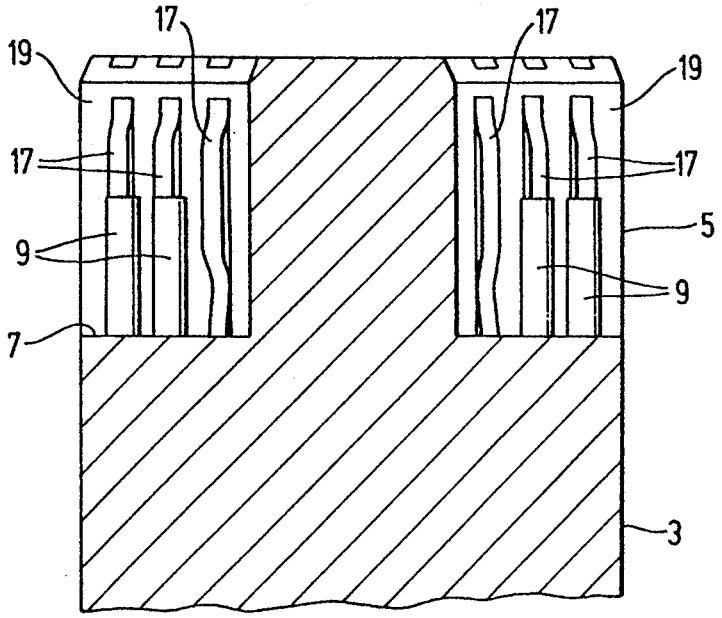
FIG. 4 is a side plane view of the present invention.

In accordance with the preferred embodiment of the present invention, illustrated in FIGS. 2–4, sixteen leaf contacts 17 are added to provide sixteen additional pathways for coupling electrical signals from one bowtie connector 1 to another bowtie connector 1' (and consequently from one printed circuit board to another). Four such leaf contacts 17 are located along each of the four inner side walls 19 of each connector 1, 1'. Each of the leaf contacts 17 runs through the body 3 of the connector 1 in a manner similar to the male and female contacts 9, 11.

Figure 3A:
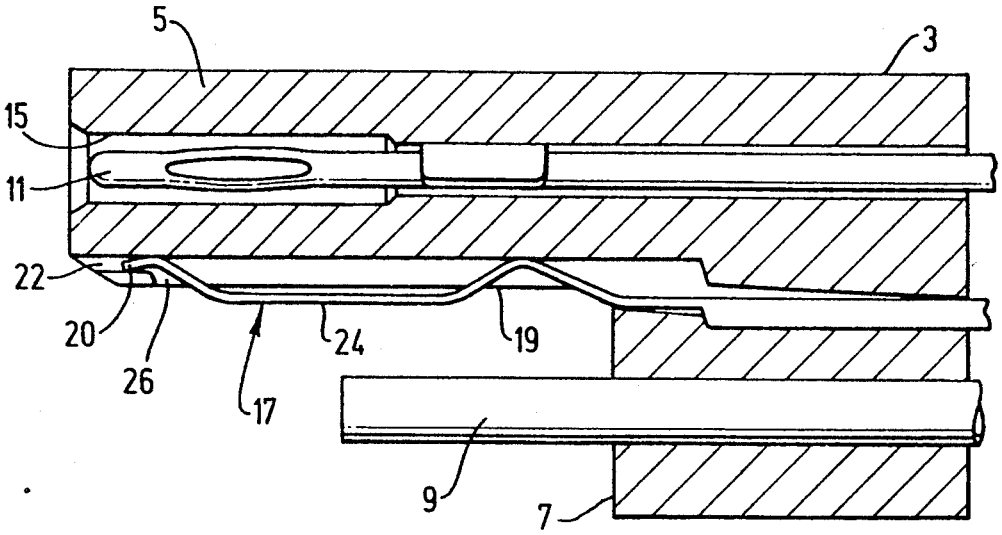
FIG. 3*a* is a cutaway view of the corner of the preferred embodiment of the present invention showing a leaf contact thereof.

FIG. 3*a* is a cutaway view of a corner of the connector of the preferred embodiment of the present invention. The leaf contact 17 which is illustrated in FIG. 3*a* has a distal end 20 located in a slot 22, thereby securing the distal end 20 to the projection 5. The leaf contact 17 also has a generally "U"-shaped central section 24. The U-shaped section 24 protrudes from the inner side wall 19 through an opening 26 therein, thereby allowing electrical contact to be made between the U-shaped section 24 of one leaf contact 17 and the U-shaped section 24 of another leaf contact 17 when two identical connectors 1, 1' are mated. When two connectors 1, 1' are so mated, the U-shaped section 24 of each leaf contact 17 applies pressure upon the U-shaped section 24 of a corresponding leaf contact 17. Therefore, each leaf contact 17 is compressed and recedes into the opening 26 in the inner side wall 19, causing the distal end 20 to move along the slot 22. The leaf contact 17 is manufactured from a resilient conductive material such that a spring compression is created between the U-shaped sections 24 of each mated leaf contact 17.

Figure 3B:
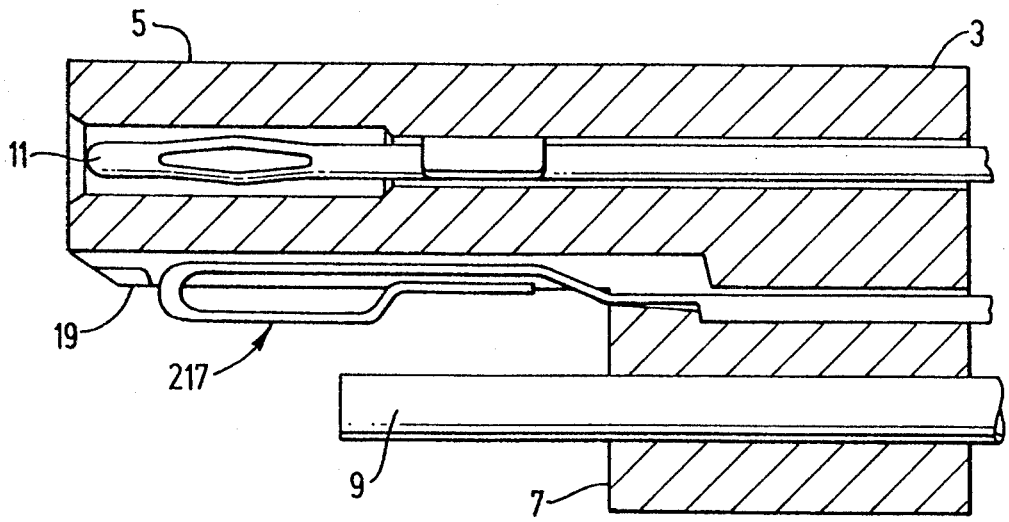
FIG. 3*b* is a cutaway view of the corner of an alternative embodiment of the present invention showing a leaf contact thereof.
Figure 3C:
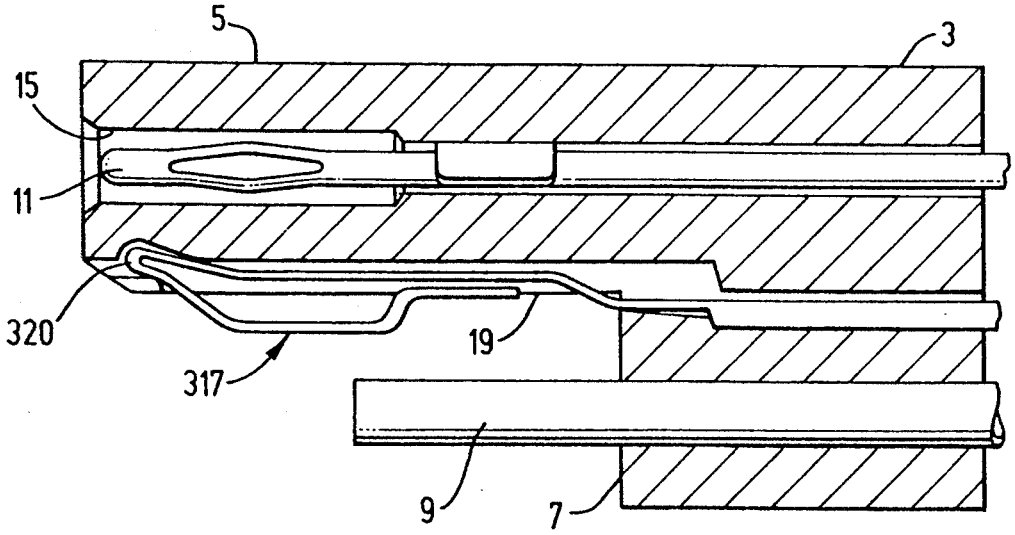
FIG. 3*c* is a cutaway view of the corner of the another alternative embodiment of the present invention showing a leaf contact thereof.

It should be understood that the leaf contacts 17 may take on a wide variety of configurations, such as being slightly curved or bowed along either, or both, the length or width of the leaf contact 17, thereby creating a controlled point of contact between mating contacts. Furthermore, the leaf contacts 17 need not be secured at the distal end 20. FIG. 3*b* illustrates an alternative configuration in which the leaf contact 217 is folded back on itself. FIG. 3*c* illustrates another alternative embodiment in which the leaf contact 317 is both secured to the inner side wall 19 at an acute bend 320 in the leaf contact 317, and is folded back on itself.

The leaf contacts 17 may be manufactured from a stamped and folded sheet of resilient conductive material, such as tin-plated copper, or by any other means to achieve a resilient conductive leaf or spring contact properly dimensioned to fit adjacent to each inner side wall 19 of the projections 5. It should be understood by these examples of the that the leaf contacts 17 of the present invention are not limited to only those examples described herein, but includes a multitude of equivalent configurations too numerous to illustrate.

Figure 5:
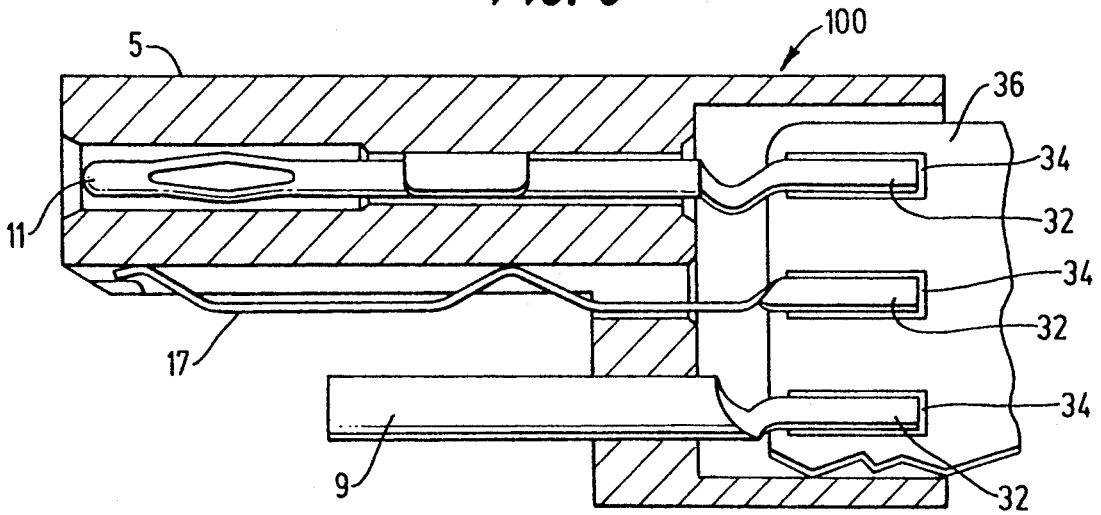
FIG. 5 is a cutaway view of an alternative embodiment of the present invention showing a leaf contact thereof.

In the preferred embodiment of the present invention, an elongated termination end of each contact (male, female, or leaf) 28 conducts electrical signals through the insulating body 3 and down to a plated through-hole 30 in a printed circuit board 13 upon which the connector 1 is mounted (shown in FIG. 2). In an alternative embodiment illustrated in FIG. 5, the termination end 32 of each contact 9, 11, 17 is twisted 90° and placed in mechanical contact with an electrical contact pad 134 on a flexible substrate 36 to which the termination end 32 is mechanically and electrically connected in known fashion, such as by soldering with molten lead-tin solder. Conductors (not shown) upon the flexible substrate 36 conduct electrical signals from each contact 9, 11, 17 to a corresponding termination post (not shown). The termination posts are inserted into plated through-holes in a printed circuit board (not shown) upon which the connector 100 is mounted. Surface mounting a termination end of a contact on a flexible substrate, as described herein, is well known in the art.

The present ivention provides a bowtie connector which has the advantage of providing additional contacts without increasing the physical size of the overall structure of an otherwise standard bowtie connector, thereby increasing the contact density of the connector.

A number of embodiments of the present invention have been described. Nevertheless, it will be understood that various modifications may be made without departing from the spirit and scope of the invention. For example, the leaf contacts may be manufactured from any resilient conductive material. Also, the leaf contact may be of any configuration which allows the mating of two essentially identical bowtie connectors for orthogonally mounting circuit boards, wherein the inner side walls of one connector slide past the inner side walls of the other connector, thereby placing corresponding leaf contacts positioned along the opposing inner side walls of mating connectors in electrical and mechanical contact with one another. Furthermore, the termination end of the leaf contacts may terminate at a rigid printed circuit board upon which the connector is mounted, a flexible circuit substrate which couples the signals from the contacts to a printed circuit board upon which the connector is mounted, or any other termination point appropriate to the specific application /f the connector. In addition, fewer than 16 leaf contacts per connector can be provided, or more than 16 leaf contacts can be provided if a larger grid pattern is used, or if the grid pattern is not strictly followed. Accordingly, it is to be understood that the invention is not to be limited by the specific illustrated embodiment, but only by the scope of the appended claims.

I claim:

1. A connector system for making multiple electrical connections, including:

(a) complementary first and second connectors, each including:

(1) an electrically-insulating connector body;

(2) a plurality of spaced-apart electrical first contacts mounted in the connector body and extending away from a substantially planar end surface of the body;

(3) a plurality of electrically-insulating projections extending away from the body end surface and beyond the free ends of the first contacts, the projections having substantially co-planar end surfaces parallel to the body end surface;

(4) a plurality of spaced-apart electric second contacts recessed within the projections and open to the projection end surfaces;

(b) at least one third contact mounted on a side of at least one projection orthogonal to the projection end surfaces, each third contact on each connector having a distal end, and being positioned complementarily to a corresponding third contact on the other connector; and (1) at least one covered slot 22, each covered slot 22 corresponding to an associated one of the third contacts, for receiving the distal end of the associated third contact;

(c) the projections of each connector diverging linearly and transversely away from a central portion of the body to form an interfacing surface consisting of the projection end surfaces alternating with sectors of the body end surface;

(d) the first and second connectors being adapted for interlocking mechanical and electrical engagement with each projection of each connector in a nesting relation between a pair of neighboring projections of the other connector, with the projection end surfaces of each connector facing the body end surface of the other connector, with the first contacts of each connector aligned and engaged with the second contacts of the other connector, and with the at least one third contact of each connector aligned and engaged with the at least one third contact of the other connector.

2. A connector system for making multiple electrical connections between complementary first and second connectors, wherein each connector includes an electrically-insulating connector body, a plurality of spaced-apart electrical first contacts mounted in the connector body and extending away from a substantially planar end surface of the body, a plurality of electrically-insulating projections extending away from the body end surface and beyond the free ends of the first contacts, the projections having substantially co-planar end surfaces parallel to the body end surface, and a plurality of spaced-apart electric second contacts recessed within the projections and open to the projection end surfaces, the projections of each connector diverging linearly and transversely away from a central portion of the body to form an interfacing surface consisting of the projection end surfaces alternating with sectors of the body end surface, the first and second connectors being adapted for interlocking mechanical and electrical engagement with each projection of each connector in a nesting relation between a pair of neighboring projections of the other connector, with the projection end surfaces of each connector facing the body end surface of the other connector, and with the first contacts of each connector aligned and engaged with the second contacts of the other connector, the connector system further comprising:

(a) at least one third contact mounted on each of the first and second connectors on a side of at least one projection orthogonal to the projection end surfaces, each third contact on each connector having a distal end, and being positioned complementarily to a corresponding third contact on the other connector, wherein the at least one third contact of each connector is aligned and engaged with the at least one third contact of the other connector when the first and second connectors are in interlocking mechanical and electrical engagement; and (b) at least one covered slot 22, each covered slot 22 corresponding to an associated one of the third contacts, for receiving the distal end of the associated third contact.

3. A bowtie connector system for making multiple electrical connections, including:

(a) complementary first and second bowtie connectors, each including;
(1) an electrically-insulating connector body;
(2) a plurality of spaced-apart electrical first contacts mounted in the connector body and extending away from a substantially planar end surface of the body;
(3) a pair of electrically-insulating projections extending away from the body end surface and beyond the free ends of the first contacts, the paired projections having substantially co-planar end surfaces parallel to the body end surface;
(4) a plurality of spaced-apart electric second contacts recessed within the projections and open to the projection end surfaces;
(5) a plurality of third contacts mounted on at least one side of at least one projection orthogonal to the projection end surfaces, each third contact on each connector having a distal end, and being positioned complementarily to a corresponding third contact on the other connector; and
(6) at least one covered slot 22, each covered slot 22 corresponding to an associated one of the third contacts, for receiving the distal end of the associated third contact;
(b) the projections of each connector being generally triangularly-shaped and having opposed apices near a central portion of the body to form an interfacing surface consisting of the projection end surfaces alternating with sectors of the body end surface; and
(c) the first and second connectors being adapted for interlocking mechanical and electrical engagement with the pair of projections of each connector in a nesting relation with the pair of projections of the other connector, with the projection end surfaces of each connector facing the body end surface of the other connector, with the first contacts of each connector aligned and engaged with the second contacts of the other connector, and with the third contacts of each connector aligned and engaged with the third contacts of the other connector.

4. A connector system for making multiple electrical connections, including:
(a) complementary first and second connectors, each including:
(1) an electrically-insulating connector body;
(2) a plurality of spaced-apart electrical first contacts mounted in the connector body and extending away from a substantially planar end surface of the body;
(3) a plurality of electrically-insulating projections extending away from the body end surface and beyond the free ends of the first contacts, the projections having substantially co-planar end surfaces parallel to the body end surface;
(4) a plurality of spaced-apart electric second contacts recessed within the projections and open to the projection end surfaces; and
(5) at least one third contact mounted on a side of at least one projection orthogonal to the projection end surfaces, at least one third contact on each connector being folded back on itself, and being positioned complementarily to a corresponding third contact on the other connector;
(b) the projections of each connector diverging linearly and transversely away from a central portion of the body to form an interfacing surface consisting of the projection end surfaces alternating with sectors of the body end surface;
(c) the first and second connectors being adapted for interlocking mechanical and electrical engagement with each projection of each connector in a nesting relation between a pair of neighboring projections of the other connector, with the projection end surfaces of each connector facing the body end surface of the other connector, with the first contacts of each connector aligned and engaged with the second contacts of the other connector, and with the at least one third contact of each connector aligned and engaged with the at least one third contact of the other connector.

5. The connector system of claim 4, wherein at least one of the third contacts of the first and second connectors is folded back on itself and is secured to the side of one projection at an acute bend in the third contact.

6. A connector system for making multiple electrical connections between complementary first and second connectors, wherein each connector includes an electrically-insulating connector body, a plurality of spaced-apart electrical first contacts mounted in the connector body and extending away from a substantially planar end surface of the body, a plurality of electrically-insulating projections extending away from the body end surface and beyond the free ends of the first contacts, the projections having substantially co-planar end surfaces parallel to the body end surface, and a plurality of spaced-apart electric second contacts recessed within the projections and open to the projection end surfaces, the projections of each connector diverging linearly and transversely away from a central portion of the body to form an interfacing surface consisting of the projection end surfaces alternating with sectors of the body end surface, the first and second connectors being adapted for interlocking mechanical and electrical engagement with each projection of each connector in a nesting relation between a pair of neighboring projections of the other connector, with the projection end surfaces of each connector facing the body end surface of the other connector, and with the first contacts of each connector aligned and engaged with the second contacts of the other connector, the connector system further comprising:
(a) at least one third contact mounted on each of the first and second connectors on a side of at least one projection orthogonal to the projection end surfaces, each being positioned complementarily to a corresponding third contact on the other connector, wherein the at least one third contact of each connector is folded back on itself and is aligned and engaged with the at least one third contact of the other connector when the first and second connectors are in interlocking mechanical and electrical engagement.

7. The connector system of claim 6, wherein at least one of the third contacts of the first and second connectors is secured to the side of one projection at an acute bend in the third contact.

8. A bowtie connector system for making multiple electrical connections, including;
(a) complementary first and second bowtie connectors, each including;
(1) an electrically-insulating connector body;
(2) a plurality of spaced-apart electrical first contacts mounted in the connector body and extending away from a substantially planar end surface of the body;

(3) a pair of electrically-insulating projections extending away from the body end surface and beyond the free ends of the first contacts, the paired projections having substantially co-planar end surfaces parallel to the body end surface;

(4) a plurality of spaced-apart electric second contacts recessed within the projections and open to the projection end surfaces; and (5) a plurality of third contacts mounted on at least one side of at least one projection orthogonal to the projection end surfaces, each third contact on each connector being folded back on itself and being positioned complementarily to a corresponding third contact on the other connector;

(b) the projections of each connector being generally triangularly-shaped and having opposed apices near a central portion of the body to form an interfacing surface consisting of the projection end surfaces alternating with sectors of the body end surface; and (c) the first and second connectors being adapted for interlocking mechanical and electrical engagement with the pair of projections of each connector in a nesting relation with the pair of projections of the other connector, with the projection end surfaces of each connector facing the body end surface of the other connector, with the first contacts of each connector aligned and engaged with the second contacts of the other connector, and with the third contacts of each connector aligned and engaged with the third contacts of the other connector.

9. The connector system of claim 8, wherein at least one of the third contacts of the first and second connectors is secured to the side of one projection at an acute bend in the third contact.

* * * * *